US005350207A

United States Patent [19]

Sanders

[11] Patent Number: 5,350,207

[45] Date of Patent: Sep. 27, 1994

[54] LOCKING ASTRAGAL

[75] Inventor: Vernard W. Sanders, Port Hueneme, Calif.

[73] Assignee: Pemko Manufacturing Company, Ventura, Calif.

[21] Appl. No.: 878,336

[22] Filed: Apr. 30, 1992

[51] Int. Cl.[5] ..... E05B 63/20

[52] U.S. Cl. ..... 292/335; 292/42

[58] Field of Search ..... 292/152, 153, 147, 335, 292/32, 42, 334; 49/369

[56] References Cited

U.S. PATENT DOCUMENTS

| | | | |
|---|---|---|---|
| 137,211 | 3/1873 | Jones . | |
| 777,686 | 12/1904 | Moore et al. | 292/147 |
| 1,111,425 | 9/1914 | Ziganet et al. . | |
| 1,272,115 | 7/1918 | Russell . | |
| 1,297,528 | 3/1919 | Wright . | |
| 1,360,413 | 11/1920 | Kondrat | 292/147 |
| 2,010,461 | 8/1935 | Milligan . | |
| 2,086,049 | 7/1937 | Schlaman | 292/341.19 |
| 2,710,216 | 6/1955 | Eichacker | 292/335 |
| 3,096,113 | 7/1963 | Polyin | 292/147 |
| 3,263,351 | 8/1966 | Olson | 292/335 X |
| 3,378,290 | 4/1968 | Sekulich . | |
| 3,617,080 | 11/1971 | Miller . | |
| 3,649,060 | 3/1972 | Ruff | 292/147 X |
| 3,806,175 | 4/1974 | Van Herpen | 292/147 |
| 4,428,605 | 1/1984 | Follows | 242/152 |
| 4,429,493 | 2/1984 | St. ASubin | 49/367 |
| 4,773,682 | 9/1988 | Saelzer | 292/143 |
| 4,993,758 | 2/1991 | Schmetzler | 292/152 |

FOREIGN PATENT DOCUMENTS

| | | |
|---|---|---|
| 2448840 | 4/1976 | Fed. Rep. of Germany . |
| 2110288 | 6/1983 | United Kingdom . |

OTHER PUBLICATIONS

Imperial Products, Inc. astragal brochure, dated Jul. 1, 1988.

Ultra Industries, Inc. WS059 brochure, 1991.

Combo Aluminum Products Astragal & Meeting Stiles brochure, 1992.

Indal Aluminum Products T-Bolt Astragal brochure, 1992.

*Primary Examiner*—Rodney M. Lindsey

*Attorney, Agent, or Firm*—Spensley, Horn, Jubas & Lubitz

[57] ABSTRACT

A locking astragal for attaching to an inactive leaf of a double doorway. In the illustrated embodiment, an elongated astragal casing has a channel and bolt-slide assemblies mounted slidably within the channel. Each bolt-slide assembly includes a latching member and bolt. By depressing the latching member, the latching member can slide through the channel to extend and lock the bolts into indentations in the upper and lower surfaces of the door frame. The bolts may also be retracted back into the astragal to open the inactive leaf. In the illustrated embodiment, each latching member has an integral spring which simplifies fabrication and assembly.

18 Claims, 15 Drawing Sheets

LOCKING ASTRAGAL

BACKGROUND OF THE INVENTION

1. Field of the Invention

The present invention relates to locking astragals for application in double doorways. The astragal is fastened to one of the doors which is primarily retained in a fixed, closed position within the door frame.

2. Description of Related Art

Double entrance doorways are often used in residential homes or business suites for their functional as well as aesthetic characteristics. Typically, one of the doors in the double doorway usually remains shut and is fixed to the door frame by various types of bolts and/or locking mechanisms. This fixed door is generally referred to as the inactive leaf. The other free-swinging door, or active leaf, is commonly used as the main entrance door through which people can enter. If large objects such as furniture or the like must pass through the entrance, the normally inactive leaf of the doorway can be readily unbolted from the door frame so that both doors can be opened to create a wide entrance way through which the furniture or other object may pass.

Generally, the mating edges of double doors do not directly contact each other, but are separated by an astragal. Typically, the astragal is attached to the edge of the inactive leaf and extends the length of the door. The astragal cushions the closing of the active leaf of the doorway and seals gaps between the two doors.

Astragals commonly include upper and lower bolt-slide assemblies which include locking bolts that slide within the upper and lower ends of the astragal. The bolts can be pushed outwardly to extend beyond the ends of the astragal. The bolts when extended are received by upper and lower apertures in the upper and lower sections of the door frame, also known as the header and threshold sill, respectively, to lock the inactive leaf in place.

Many bolt-slide assemblies have knobs which facilitate manually sliding the bolts to lock the bolts into the door frame. The knobs are usually flush with the edge of the door so that they do not protrude out of the door thereby obstructing the closing of the opposite door, but the knobs may be designed to be pulled out from the edge of the door frame to provide greater leverage for manual adjustment of the bolt. However, knobs which are attached directly to the bolt are often difficult to reach and manipulate.

To allow easier access to and adjustment of the bolts, the bolt-slide assemblies of some astragal devices have extension cables and spring components which allow the bolts to be manipulated near the center of the door edge. For example, one door latch device has a cable attached at one end to the bolt and, at the other end, to a sliding retractor which can be manipulated to retract the bolt via the cable. The extension cable which connects the bolt to the manual retractor allows the retractor to be at an easily accessible height near the center of the door. A spring is typically located between each cable and bolt to bias the bolt in an outwardly extended, locked position. As the retractor is pulled inward, the spring stretches as the bolt is retracted. When the retractors are released or pushed outward, the bolt will snap outward into the extended, locked position as the tension on the spring is dissipated.

Many retractors have a latching mechanism which allows the bolt to be latched in the inward, retracted position. In one latching arrangement, a thin, elongated metal latch bar is housed within a plastic retractor housing, or pull block. One end of the latch bar protrudes from the top of the pull block and pivots about a pin within the pull block. The other end of the latch bar has a small protrusion which fits into a circular hole in a bottom plate to lock the retractor in place. A compression spring, located between the underside of the housing and the unexposed end of the latch, biases the latch bar in the downwardly locking position in the hole in the bottom plate.

When the protruding end of the latch bar is depressed, the latch bar pivots about the pin, simultaneously compressing the spring and releasing the protrusion from its locked position in the bottom plate. The retractor is thereby released, allowing the door bolt to slide outwardly into the extended locked position. Such latching mechanisms, however, are relatively complicated to manufacture and assemble and are susceptible to increased mechanical failures resulting from the multiple individual components.

In another aspect of locking astragal assemblies, one or more strike plates are provided near the center of the astragal to fit around an opening or channel in the astragal through which bolts of a door lock or dead bolt mechanism in the opposing active leaf can pass to securely lock the doors together. Typically, the strike plate must be carefully adjusted to precisely align with the door lock and dead bolt which may have already been installed in the active leaf.

A variety of methods are used to align the strike plate on the astragal with the door lock and bolt in the opposing door. For example, in one trial-and-error method, the strike plate is hand-adjusted to exactly line up with the door bolt so that the door lock and dead bolt can close and lock properly with the opposite door. After it appears that the proper alignment has been achieved, holes are drilled in the astragal or spacers in the astragal to install the strike plate. If the alignment was not properly achieved, the holes for the strike plate typically need to be redrilled. Thus, numerous holes may be unnecessarily drilled in the surface of the astragal casing or spacers to receive the strike plate screws.

In some instances, it may be necessary to realign the entire astragal so that a bolt can fit within and through the bolt channel formed in the astragal. It can be readily appreciated that such trial-and-error methods can be time consuming and therefore expensive.

SUMMARY OF THE INVENTION

It is an object of the present invention to provide an improved locking astragal assembly obviating for practical purposes the above-mentioned limitations, particularly in a manner requiring a relatively uncomplicated mechanical arrangement.

These and other objects and advantages are achieved in an astragal having, in accordance with the illustrated embodiment of the present invention, a bolt-slide assembly including a latching member having an integral spring portion which biases the latching member in a latched position. The latching member is pivotably housed within a pull block slidably disposed within a channel in an elongated casing. The pull block is coupled to a bolt which may be locked into or retracted from a door frame in order to lock a leaf, such as the inactive leaf to which the astragal is attached, to the door frame. Such an arrangement has been found to provide a locking astragal which simplifies fabrication and assembly.

DETAILED DESCRIPTION OF THE DRAWINGS

The following description is of the best presently contemplated mode of carrying out the invention. In the accompanying drawings, like numerals designate like parts in the several figures. This description is made for the purpose of illustrating the general principals of the invention and should not be taken in a limiting sense. The scope of the invention is best determined by reference to the accompanying claims.

Figure 1:
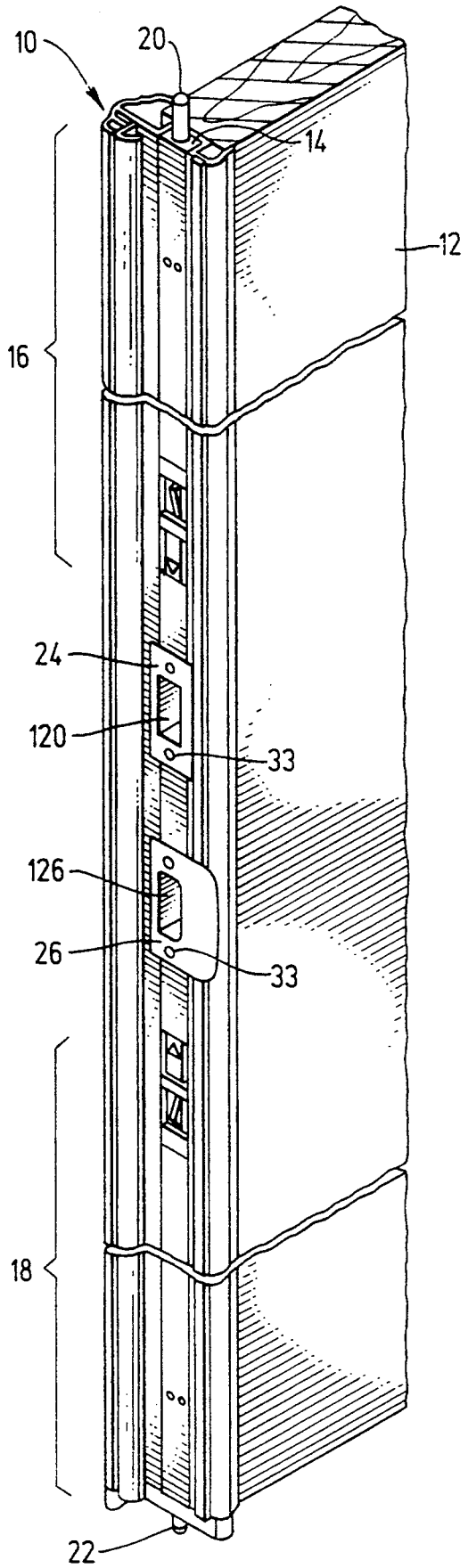
FIG. 1 is a perspective view of a locking astragal in accordance with a preferred embodiment of the present invention.
Figure 2:
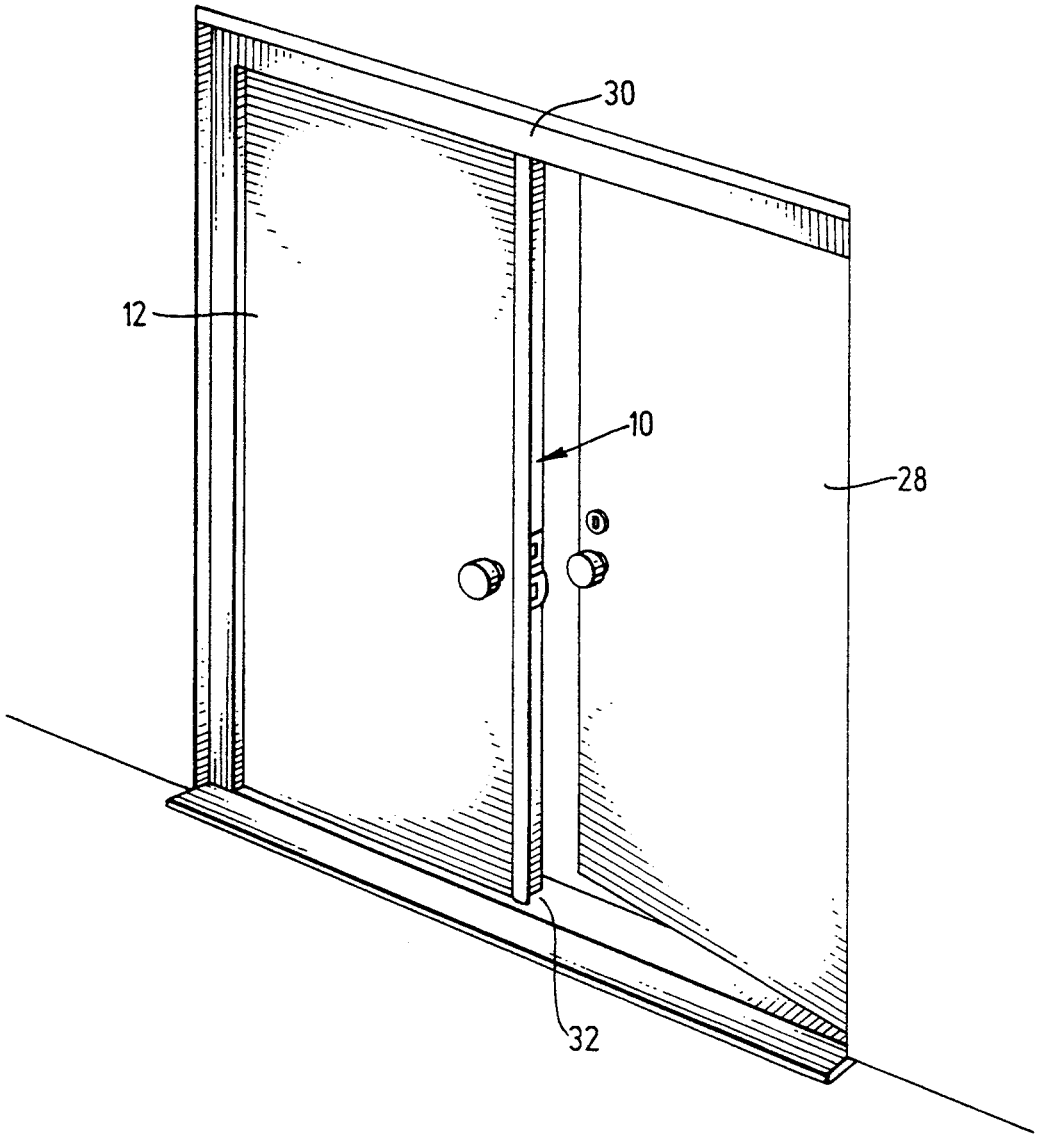
FIG. 2 is a perspective view of the astragal of FIG. 1 installed in a double doorway.

A locking astragal in accordance with a preferred embodiment of the present invention is indicated generally at 10 in FIG. 1. The size of the astragal 10 varies according to the height and thickness of the door 12 to which it is attached. As shown in FIG. 2, the astragal 10 preferably extends the entire length of the door 12 and is firmly secured to the door by means of screws or other appropriate attachments means. When the astragal is bolted to the door frame, the door to which the astragal 10 is fastened is secured in position.

Figure 3:
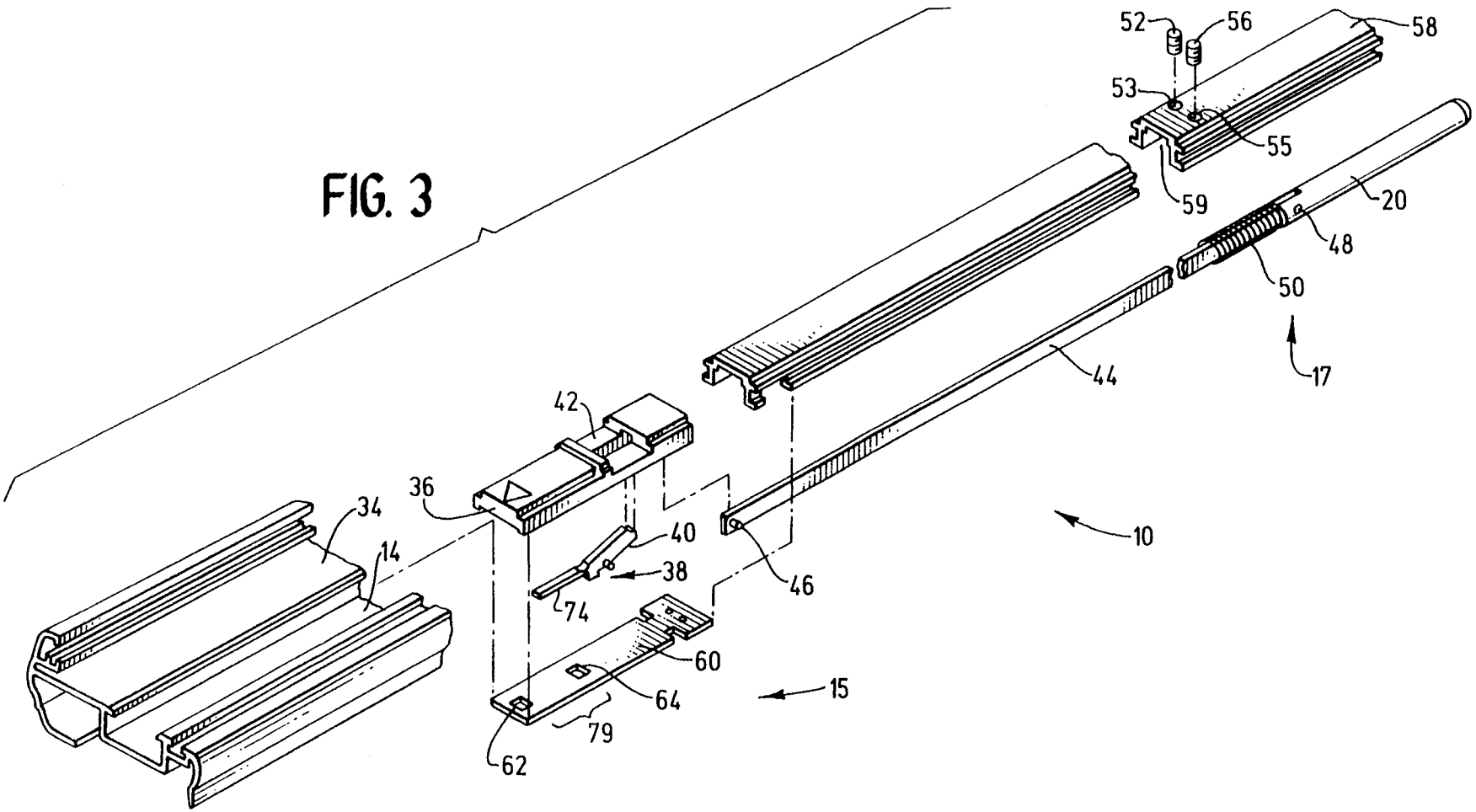
FIG. 3 is an exploded view of a bolt-slide assembly of the astragal of FIG. 1.

As shown in FIGS. 1 and 3, the astragal 10 includes a channel 14 extending the length of the astragal. A bolt-slide assembly 16 is slidably mounted at the upper end of the channel 14 near the top of the door frame, also known as the header. Similarly, a second bolt-slide assembly 18 is mounted at the lower end of the channel near the bottom, or threshold sill, of the door frame. Each bolt-slide assembly comprises a latching subassembly 15 and a bolt subassembly 17 (see FIG. 3).

For example, FIG. 2 is a general perspective view of the astragal 10 mounted on the inactive leaf 12 of a double doorway, the active leaf 28 being slightly ajar. The astragal 10 and the inactive leaf 12 are secured to the header 30 and threshold sill 32 of the door frame by the bolt-slide assemblies 16, 18 of the illustrated embodiment shown in FIG. 1. Bolts 20 and 22 extend out from the top and bottom of the astragal and lock into apertures or holes drilled in the header 30 and sill 32 of the door frame.

The astragal 10 has two strike plates 24, 26 positioned approximately at the center of the astragal 10. The strike plates 24, 26 have apertures 120, 126 that receive the bolts of the door look and dead bolt of the active leaf 28 when the double doors are closed and locked together. The strike plates 24, 26 are attached to the astragal 10 by screws 33, as will be discussed in greater detail below in connection with FIG. 14.

The astragal 10 has a captive nut feature which allows the strike plates 24, 26 to be shifted to precisely align the apertures 120, 126 in the strike plates with the lock or dead bolt in the active leaf and then secured in place without the necessity for drilling any holes in the astragal.

The individual components of the bolt-slide assembly 16 together with a portion of the astragal casing 34 are shown in greater detail in FIG. 3. The outer astragal casing 34 is formed of an extruded material, preferably aluminum or other metal, with holes for screws and the like punched or drilled into the surface of the casing. An elongated channel 14 is formed down the length of the casing 34.

Figure 6A:
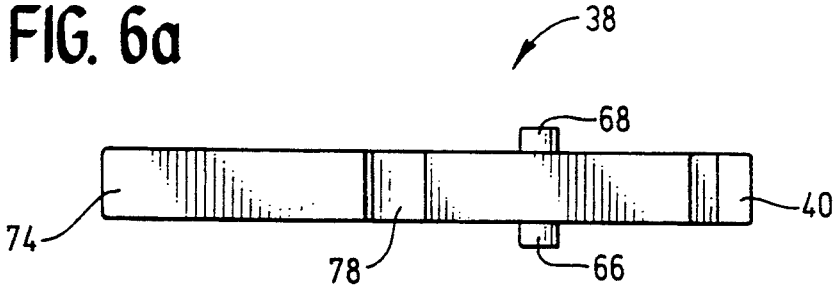
FIGS. 6*a–c* are top, side, and bottom views of the latching member of the latching subassembly of FIG. 4.
Figure 6B:
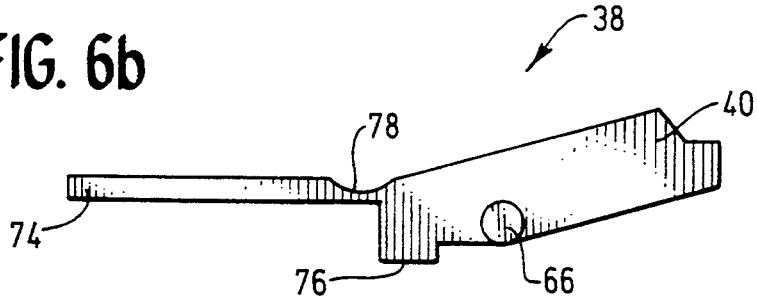

The latching subassembly 15 fits slidably within the channel 14. The latching subassembly 15 includes a latching member 38 mounted within a pull block 36. In one feature of the invention, the latching member 38 has a manually actuable lever arm 40 at one end and an integral spring tail 74 at the other end. The lever arm 40 and spring tail 74 are separated by a concave crease 78, shown enlarged in FIGS. 6*a* and 6*b*. The latching member 38 is bent slightly at the crease 78, such that the spring tail 74 forms an integral spring. As explained below, this unitary construction can simplify not only fabrication but also assembly of the latching subassembly 15.

Figure 7A:
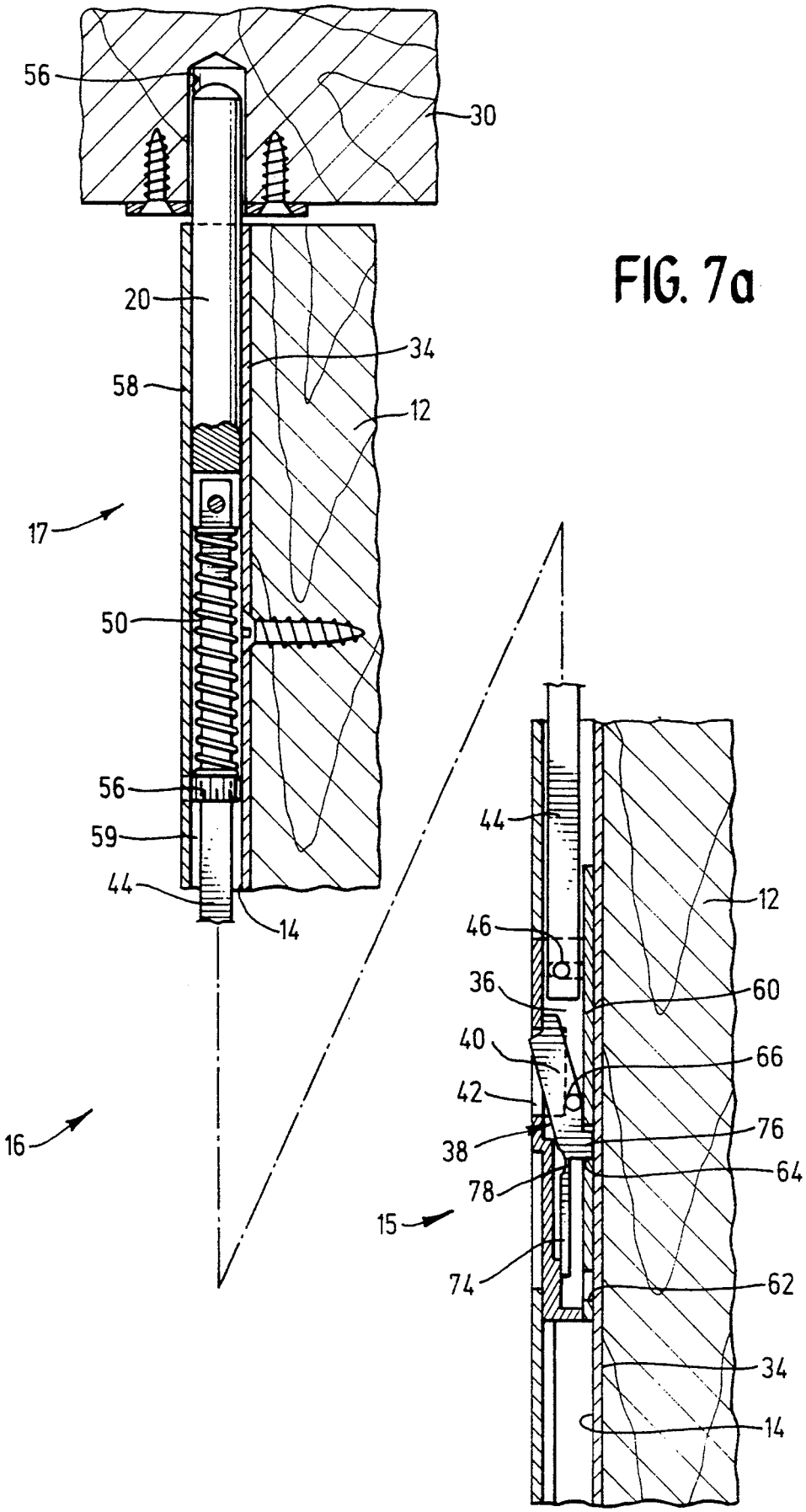
FIG. 7*a* is a cross-sectional side view of the bolt-slide assembly of FIG. 4 depicting the latching member in an extended position with the locking bolt in the extended locked position.

As best seen in FIG. 7*a*, the lever arm 40 of the latching member 38 extends through an elongated aperture 42 formed in the top of the pull block 36. The pull block 36 is coupled to the bolt 20 by an elongated connector 44. A spring pin 46 attached to one end of the connector 44 is secured in a slot 47 (FIG. 4) formed in the underside of the pull block 36. The spring pin 46 prevents the connector 44 from separating from the pull block 36, yet provides a quick and simple means for securing the connector 44 to the pull block 36.

Figure 4:
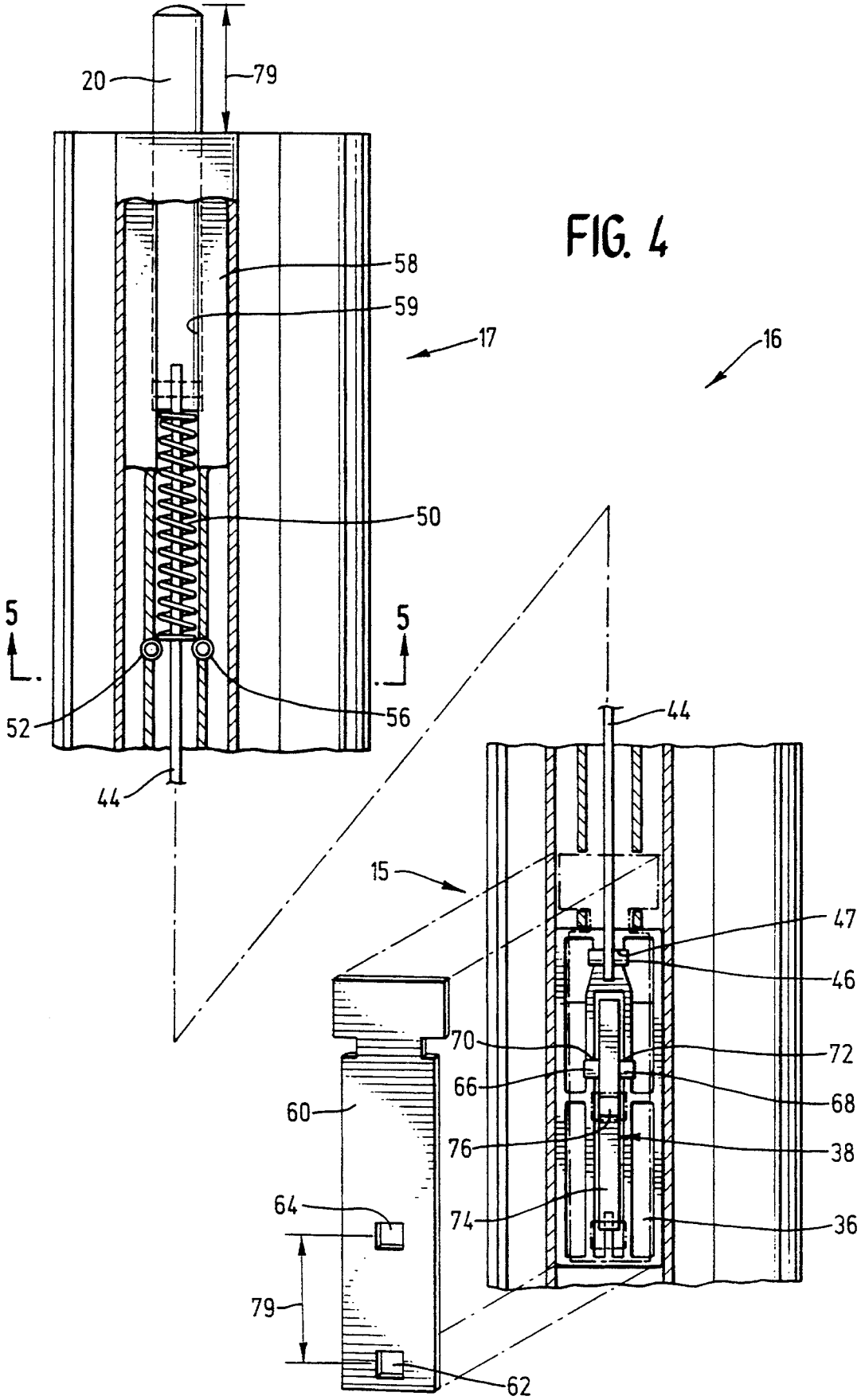
FIG. 4 shows a bottom plan view of the bolt-slide assembly of the astragal of FIG. 1, depicting a locking bolt subassembly in an extended locked position and a latching subassembly in the extended latched position.

The bolt subassembly 17, shown in greater detail in FIG. 4, includes the connector 44, a compression spring 50, set screws 52, 56, and the bolt 20. The compression spring 50 is positioned about the end of the connector 44 near the bolt 20 to exert pressure on the bolt 20 when it is in a retracted position (FIG. 7*c*), thereby biasing the bolt 20 toward an extended, locked position (FIG. 7*a*).

Figure 5:
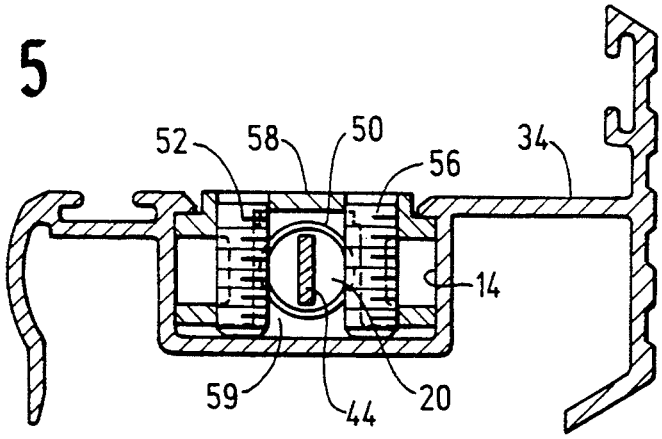
FIG. 5 is a cross-sectional view of the aspect of the locking bolt subassembly of the bolt-slide assembly of FIG. 4, as viewed along lines 5—5.

The two set screws 52, 56 are mounted on either side of the connector 44. As illustrated in FIG. 3, the set screws 52, 56 are received in holes 53, 55 drilled and threaded through a cover bar 58 which covers the length of the connector 44, spring 50, and bolt 20. The screws 52, 56 pass down through the channel 14 in the casing 34 on both sides of the connector 44. The spring 50 is secured in place between the set screws 52, 56 and the end of the bolt 20 since the spring 50 has a diameter slightly smaller than the diameter of the bolt 20, but larger than the spacing between the set screws 52, 56 (see FIG. 5).

As best seen in FIGS. 3 and 7*a–c*, the cover bar 58 defines a guide groove 59 to guide the movement of the locking bolt 20. In addition, the cover bar 58 covers the bolt subassembly 17 within the channel 14 and protects the components from corrosion and/or vandalism. The cover bar 58 may be formed of plastic or other material including the same material as the astragal casing.

Figure 7B:
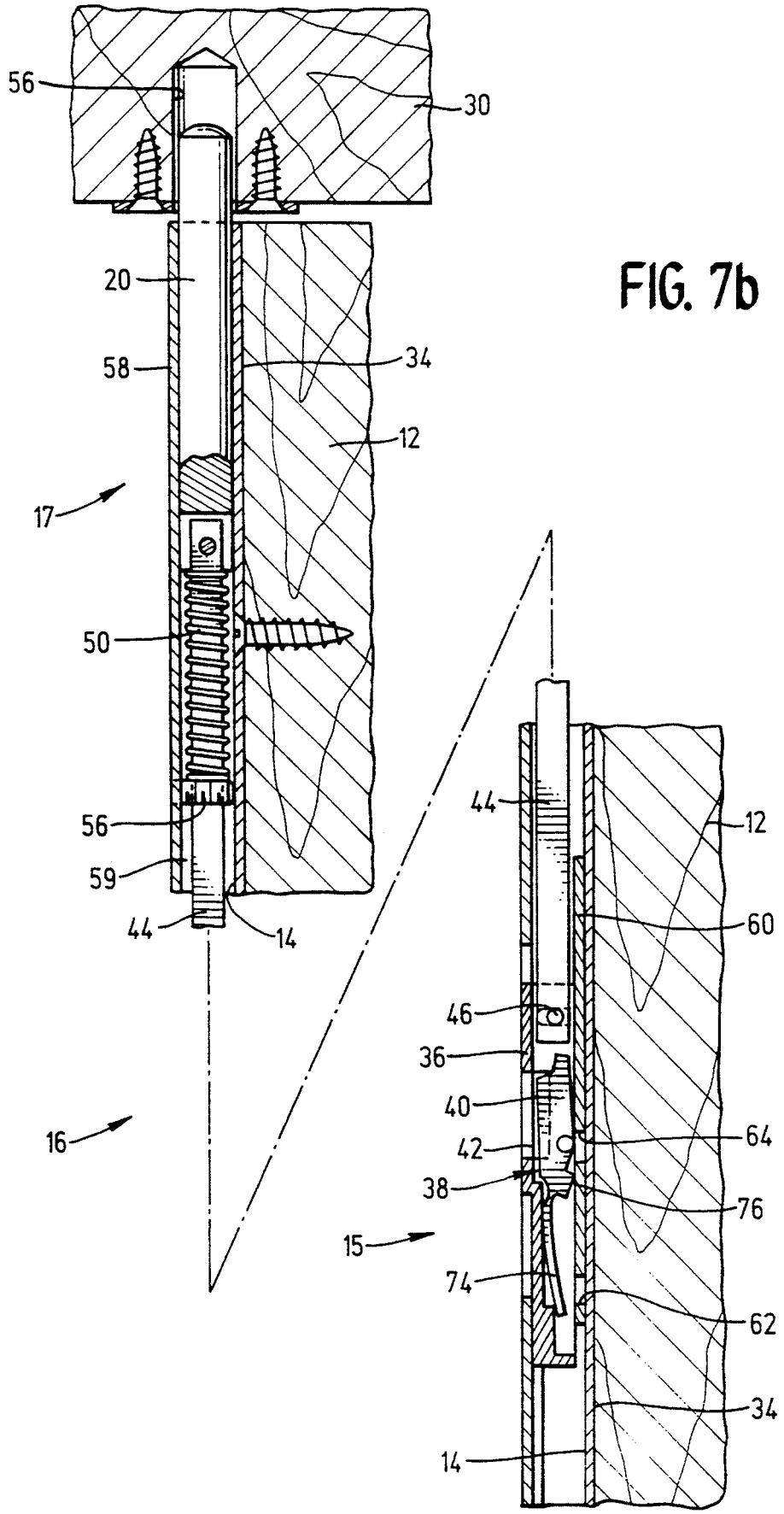
FIG. 7*b* is a cross-sectional side view of the bolt-slide assembly of FIG. 4 depicting the latching member in a disengaged position with the locking bolt being retracted from the extended locked position.
Figure 7C:
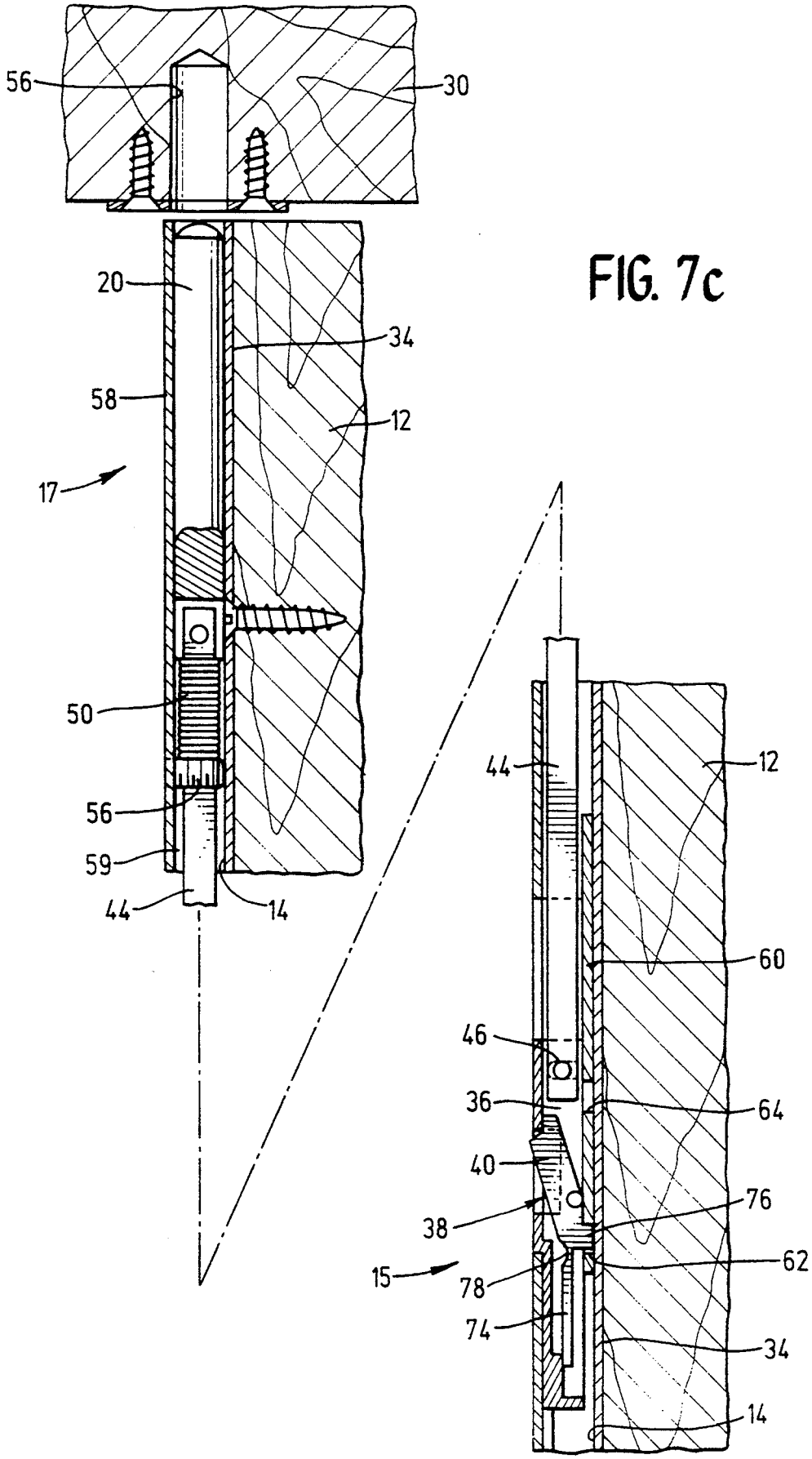
FIG. 7*c* is a cross-sectional side view of the bolt-slide assembly of FIG. 4 depicting the latching member in a retracted position with the locking bolt in the retracted position.

Beneath the pull block 36 and the latching member 38, an elongated slide plate 60 fits into the bottom of the channel 14. The slide plate 60 has two apertures, a retracted position locking aperture 62 and an extended position locking aperture 64. When the latching member 38 engages either of the apertures, the bolt 20 is secured in place (FIGS. 7*a* and 7*c*). The two apertures 62, 64 are separated by a predetermined distance 79 that represents the displacement of the bolt 20 from the retracted position to the extended position. In most instances, the spacing between the apertures equals the length of the bolt 20 that will extend out from the end of the astragal 10, also shown in FIG. 4.

Figure 6C:
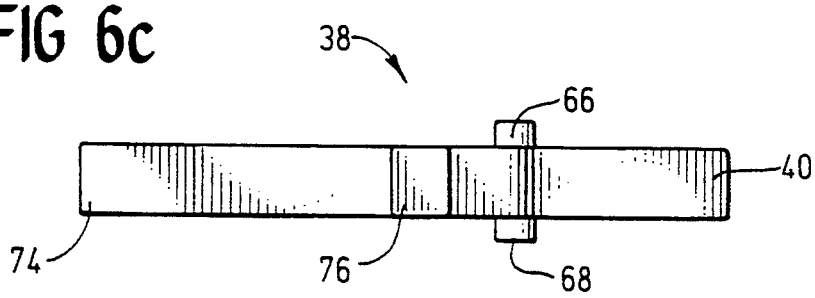

In the latching subassembly 15, the bent latching member 38 is pivotable about integral trunnions 66, 68 (FIGS. 6*a–c*) extending from opposite sides of the lever arm 40. The trunnions 66, 68 snap into trunnion bearings 70, 72 formed in the underside of the pull block 36. The lever arm 40 and spring tail 74 are separated by a latching protrusion or "dog" 76 extending from the bottom of the latching member 38. As best seen in FIGS. 7*a* and 7*c*, the latching dog selectively fits into one of the two apertures 62, 64 in the slide plate 60.

When the latching dog 76 engages the retracted position locking aperture 62, the bolt 20 is retracted into the astragal 10 (see FIG. 7*c*). To bolt the door 12 in place, the belt-slide assembly 16 is slid outward (FIG. 7*b*) toward the end of the astragal 10 until the latching dog 76 is secured in the extended position locking aperture 64 (FIG. 7*a*). The bolt 20 extends out of the astragal 10 and locks into the indentation 56 in the door frame.

When the bolt 20 is in the extended position (FIG. 7*a*), the spring 50 returns substantially to its original shape. However, when the latching dog 76 is slid (FIG. 7*b*) toward the retracted position locking aperture 62 to retract the bolt into the astragal 10, the spring 50 will be compressed between the set screws 52, 56 and the bolt 20. As best shown in FIG. 7*b*, the latching member 38 is released by depressing the lever arm 40 to disengage the latching dog 76 from the retracted position locking aperture 62. When the latching dog 76 is disengaged, the latching subassembly 15 can be moved over the slide plate 60 until the latching dog 76 engages the extended position locking aperture 64 (FIG. 7*a*). Simultaneously, the compressed spring 50 is released.

Turning now to the latching subassembly 15, FIGS. 7*a* and 7*c* show the latching member lever arm 40 extending out of the aperture 42 in the top surface of the pull block 36 within the channel 14. The spring tail 74 of the latching member 38 rests adjacent the underside of the pull block 36. When the lever arm 40 is depressed downward, the spring tail 74 reflexively exerts pressure upward, causing the latching member 38 to straighten out at the crease 78. This arrangement, in turn, disengages the latching dog 76 from the aperture 64 and enables the latching member 38 and the pull block 36 to be moved across the slide plate 60, as illustrated in FIG. 7*b*.

As the bolt-slide assembly 16 is slid toward the retracted position locking aperture 62 to retract the bolt 20 from the indentation 56 in the door frame, the latching dog 76 remains disengaged. When the bolt 20 reaches the fully retracted position and the lever arm 40 is released, the latching member 38 returns to its creased position and the latching dog 76 engages the retracted position locking aperture 62 (FIG. 7*c*).

In the above-described embodiment, the pull block 36 and slide plate 60 nay be formed of a rigid molded polyamide material or the like. The latching member preferably is formed out of a single piece of acetel plastic, one of which is Delrin ®, manufactured by DuPont Corporation. It has been found that acetal plastic provides a particularly flexible spring arm and the combination of acetal plastic and nylon allow for smooth roller/bearing assemblies. Moreover, the unitary construction of the latching member provides for greater ease of fabrication and assembly of the individual parts of the latching subassembly.

In addition, the radius of curvature of the concave crease 78 preferably is approximately 0.135 inch, the actual curvature selected depending upon the material used in the latching member 38 and the physical proportions of the lever arm 40 and spring tail 74 to provide the desired spring force.

In the illustrated embodiment, the latching member 38 is approximately 4.5 mm wide along its entire length. Another advantage of the bolt-slide assembly of the illustrated embodiment is that when the pull block 36 and latching member 38 assembly are to be moved, pressure can be comfortably applied manually to the relatively broad lever arm 40 of the latching member 38.

Still, another advantage of the illustrated embodiment is that the latching dog 76 of the present invention has a relatively wide surface for engaging the aperture. More particularly, the latching dog 76 is in the form of a square block. The apertures 62, 64 in the slide plate 60 in which the block fits are also square-shaped. When the latching member 38 is in its released, creased position, the block-shaped latching dog 76 conformably engages one of the square-shaped apertures. It has been found that such a configuration provides improved security ever prior art latching devices since the wide frontal surface of the latching dog 76 tends to avoid warping or damaging the aperture.

Figure 8:
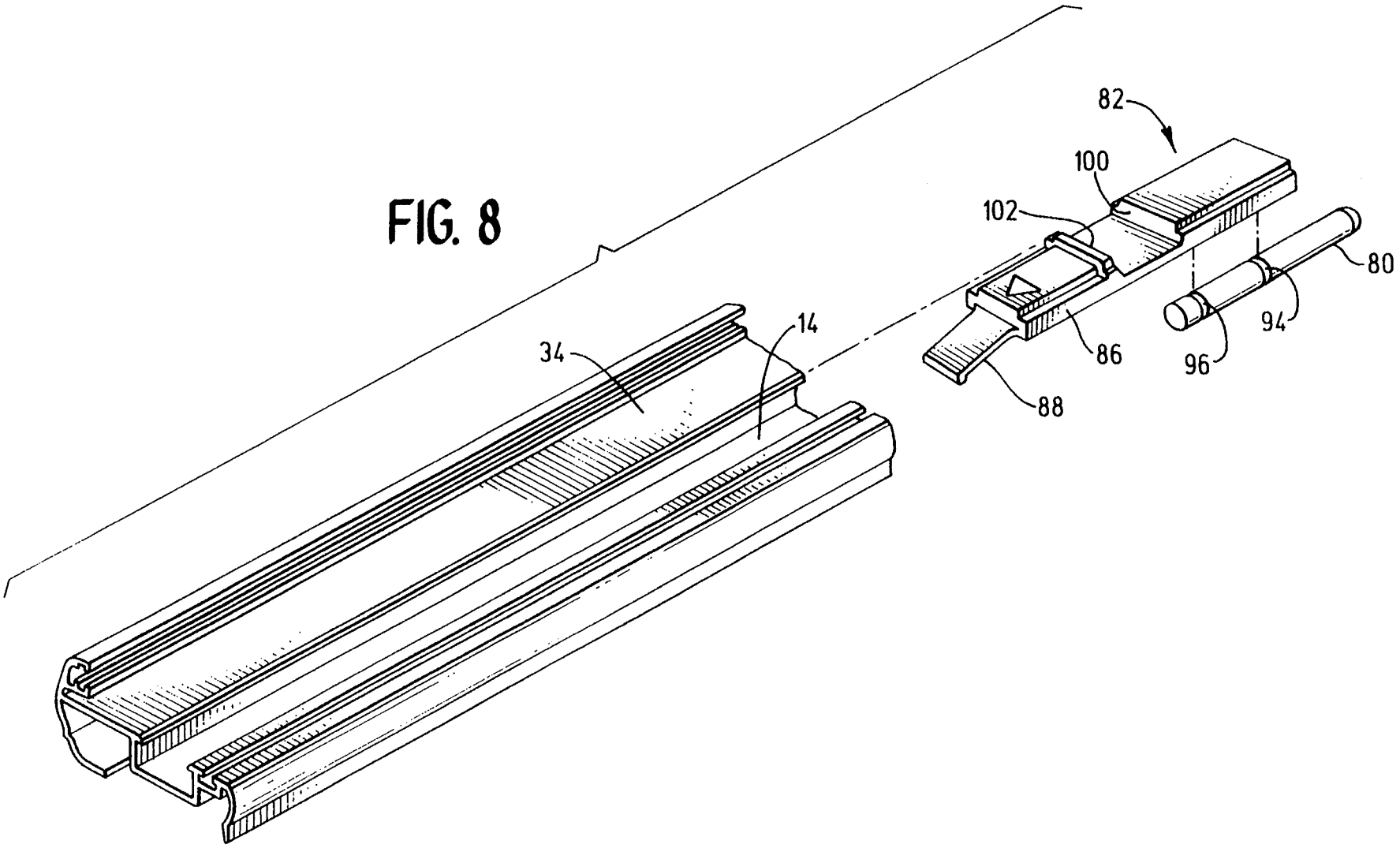
FIG. 8 is an exploded view of a bolt-slide assembly of an astragal according to another embodiment of the present invention.
Figure 9D:
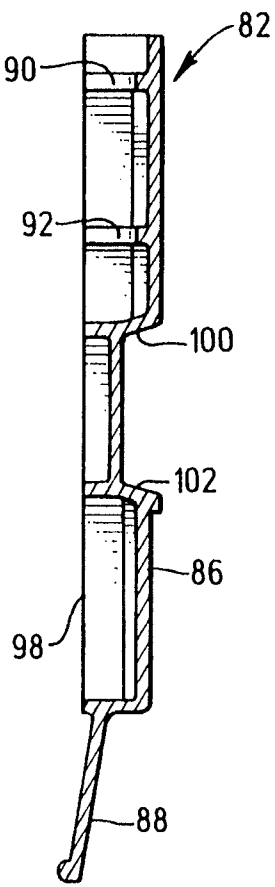
FIGS. 9*a–d* are bottom, side, top, and cross-sectional views of the latching member of the bolt-slide assembly of FIG. 8.
Figure 9C:
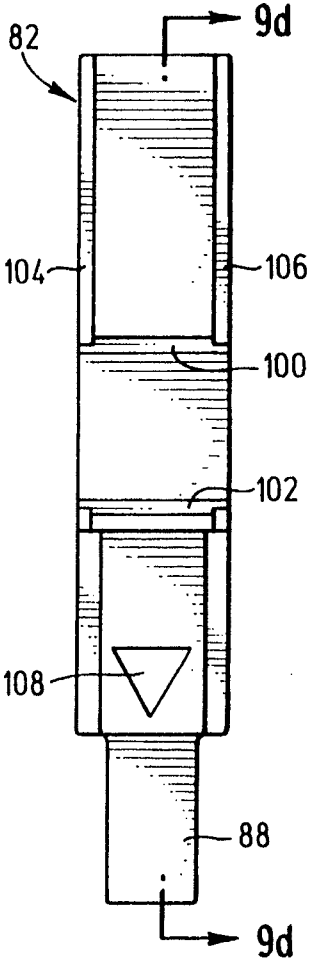
Figure 9B:
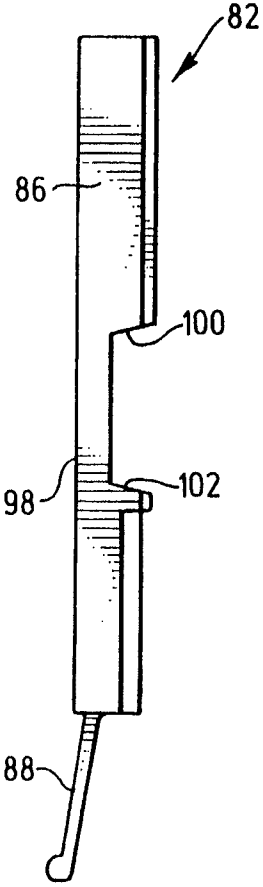
Figure 9A:
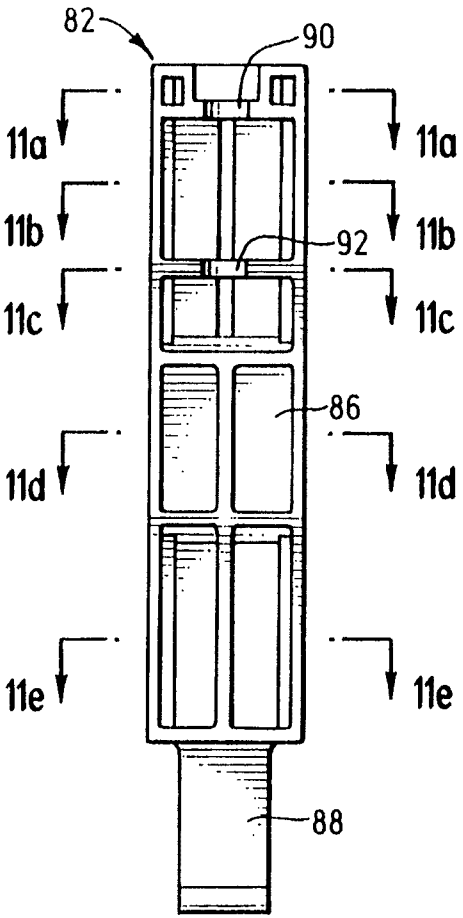

FIG. 8 shows an alternate embodiment in which actuation of a bolt 80 is controlled by a latching member 82 that frictionally engages the channel 14 in the astragal casing 34. In this embodiment, the bolt 80 is directly coupled to the latching member 82. The bolt 80 extends from and retracts into the astragal channel 14 as the latching member 82 is slid through the channel 14, frictionally contacting the inside surfaces of the channel 14 (see FIGS. 12*a–c*). Such an arrangement has been found to provide an economical mechanism for securing the bolt 80 within the astragal 10.

Figure 12C:
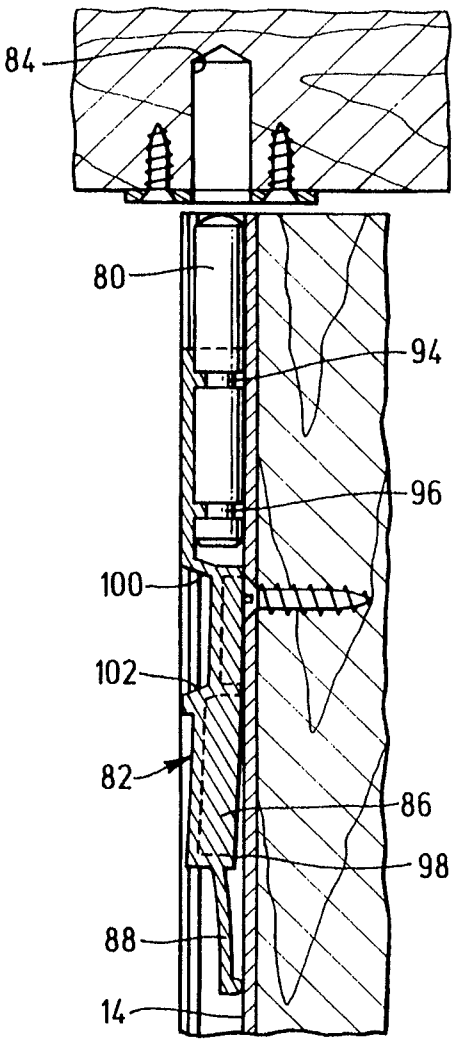
FIG. 12*c* is a cross-sectional side view of the latching assembly of FIG. 8 depicting the latching member in a retracted position with the locking bolt retracted within the astragal.
Figure 12B:
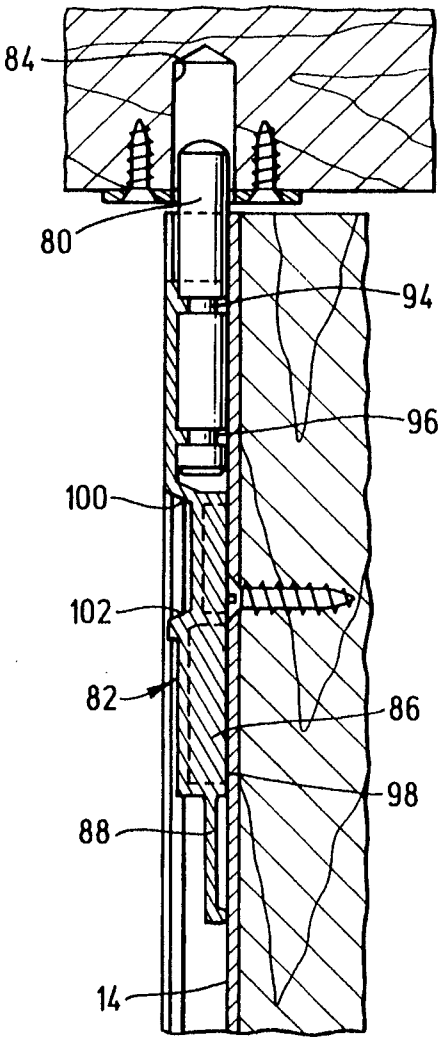
FIG. 12*b* is a cross-sectional side view of the latching assembly of FIG. 8 depicting the latching member in a disengaged position as the locking bolt is retracted from the extended locked position.
Figure 12A:
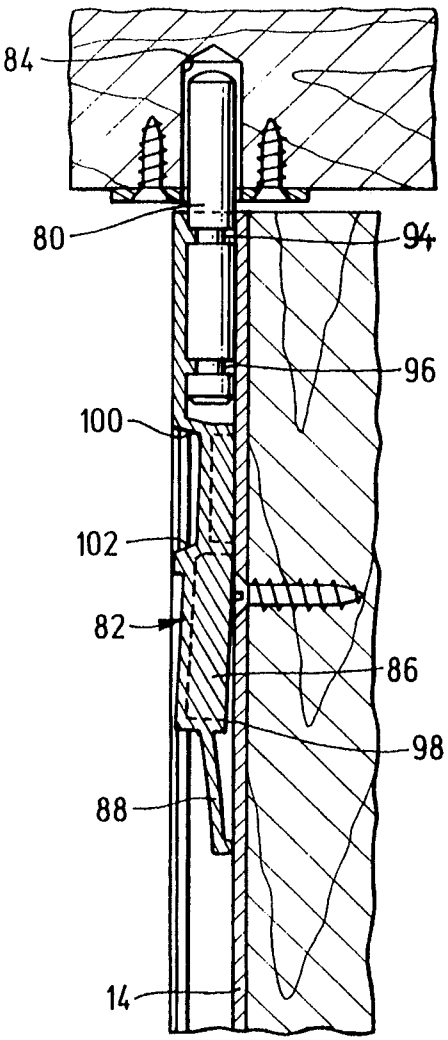
FIG. 12*a* is a cross-sectional side view of the latching assembly of FIG. 8 depicting the latching member in an extended position with the locking bolt in its extended locked position.

As shown in FIGS. 9*a–d*, the latching member 82 has a unitary construction and comprises an elongated rectangular body 86 having an integral spring leaf 88 extending from the end of the body 86 and angled downward. The end of the spring leaf 88 extends below the bottom plane 98 of the body 86 of the latching member 82 and biases the sliding latching member 82 against lying flat on the bottom surface of the channel 14 (FIG. 12*a*). As a consequence the integral spring construction biases the latching member 82 in a frictionally fixed position within the channel 14 as the upper edges 104, 106 of the latching member 82 frictionally engage the edges of the channel 14 (FIGS. 12*a* and 12*c*).

The latching member 82 is also provided with angled finger markers 100, 102 which provide a secure grip to slide the latching member 82 through the channel 14. The latching member 82 can be slid manually by pushing against the finger markers 100, 102 while simultaneously pressing down on the top of the latching member to release, or disengage, the edges 104, 106 from frictional contact with the channel 14 (FIG. 12*b*). When the latching member 82 is no longer depressed, it will once again be secured in the astragal channel 14 by the frictional contact with the edges of the channel 14 under the spring tension provided by the spring leaf 88.

Figure 10:
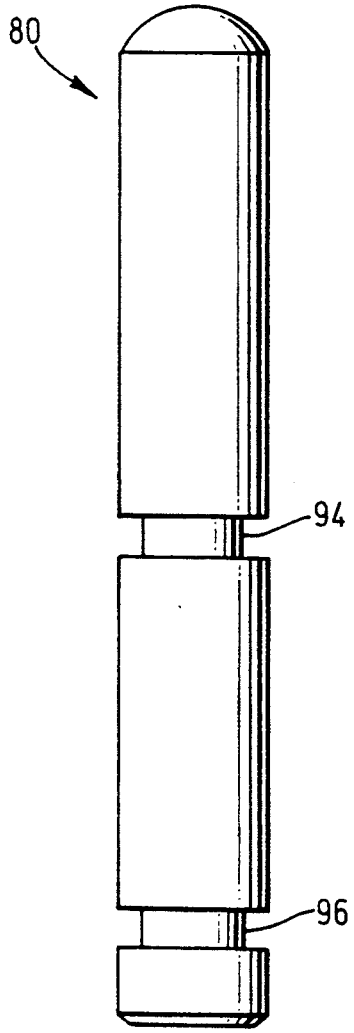
FIG. 10 is a side view of the bolt of FIG. 8.
Figure 11A:
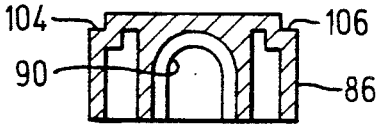
FIGS. 11*a–e* are lateral cross-sectional views of the latching member as viewed along the lines indicated in FIG. 9*a*.
Figure 11B:
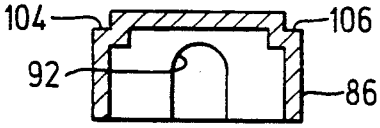
Figure 11C:
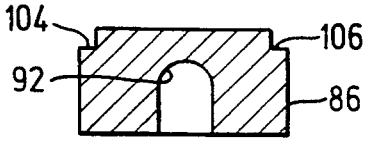
Figure 11D:
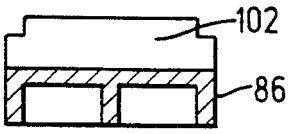
Figure 11E:
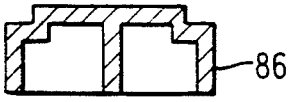

FIGS. 9*a* and 11*a–e* show receptacles 90, 92 formed on the underside of the latching member 82 for receiving the bolt 80. The bolt 80, shown enlarged in FIG. 10, is formed with grooves 94, 96 extending about its circumference. Although the bolt 80 itself may vary in diameter, the diameter of the bolt within the grooves 94, 96 should substantially conform to the widest diameter of the receptacles 90, 92 to be tightly snap-fit into the receptacles 90, 92. The grooves 94, 96 allow the bolt 80 to be securely retained in the receptacles 90, 92 so that as the latching member 82 is slid through the channel 14, the bolt 80 will move with the latching member 82, thus minimizing the possibility of breakage or slippage of the bolt 80 out of the receptacles 90, 92.

In contrast to other prior art latching devices in which a metal bolt is molded into the plastic which forms the body of the latching member, the bolt 80 in the illustrated embodiment shown in FIG. 10 is easily replaceable by simply snapping the bolt 80 out of the receptacles 90, 92 and replacing it with a different bolt. Such replacement may be necessary if a longer bolt is needed to allow better accessibility to the latching member or if the diameter of the existing bolt is not compatible with the aperture in the door frame. Thus, if desired, the bolt can be easily replaced with another bolt having a smaller or larger diameter, as long as the diameter of the grooved area around the bolt properly fits into the receptacles 90, 92.

In operation, when the bolt 80 is locked into the aperture 84 in the door frame, the latching member 82 is in a latched position when its edges 104, 106 frictionally contact the channel 14, as shown in FIG. 12*a*. The latching member 82 and bolt 80 can be retracted from the aperture 84 by depressing the top of the latching member 82 to disengage the edges 104, 106 from the channel 14 (FIG. 12*b*). When the bolt 80 is fully retracted, the latching member 82 is released and is again frictionally secured within the channel 14.

Figure 13:
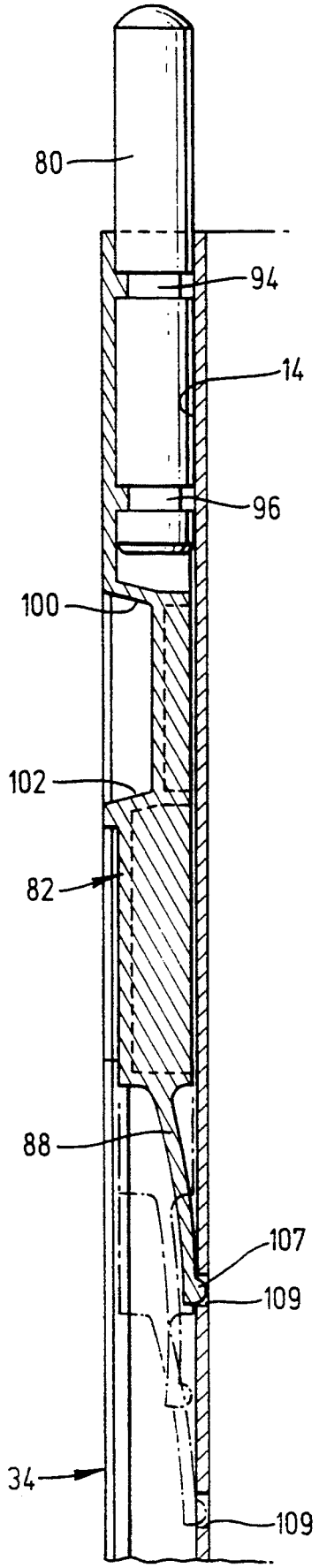
FIG. 13 is a sectional view of an alternate embodiment of the latching assembly of FIG. 8.

An alternate embodiment is illustrated in FIG. 13. The bottom surface of the channel 14 in the casing 34 is provided with several apertures 109 which act as detents. Rather than relying only on frictional force to rigidly secure the latching member 82 within the channel 14, the latching member 82 also engages the detents 109 for enhanced security. The detents 109 are constructed to receive the tip 107 of the free end of the spring rocker-arm 88 extending from the latching member 82. The spring rocker-arm 88 can be released from the detents 109 by depressing the top of the latching member 82. The latching member 82 can then be slid to another position in the channel 14. It is not required, however, that the latching member 82 engage one of the detents 109, since the latching member 82 is nevertheless securely fixed in the channel 14 by frictional contact with the sides of the channel.

In another aspect of the present invention, the astragal assembly includes at least two captive nuts 110 positioned within the channel 14 in the astragal 10 beneath the strike plate 26. Each captive nut 110 together with a screw 33 provides a significantly simplified method to secure the strike plate 26 to the astragal after the aperture 126 in the strike plate 26 has been precisely aligned with a door bolt or dead bolt in the opposite door.

Figure 14:
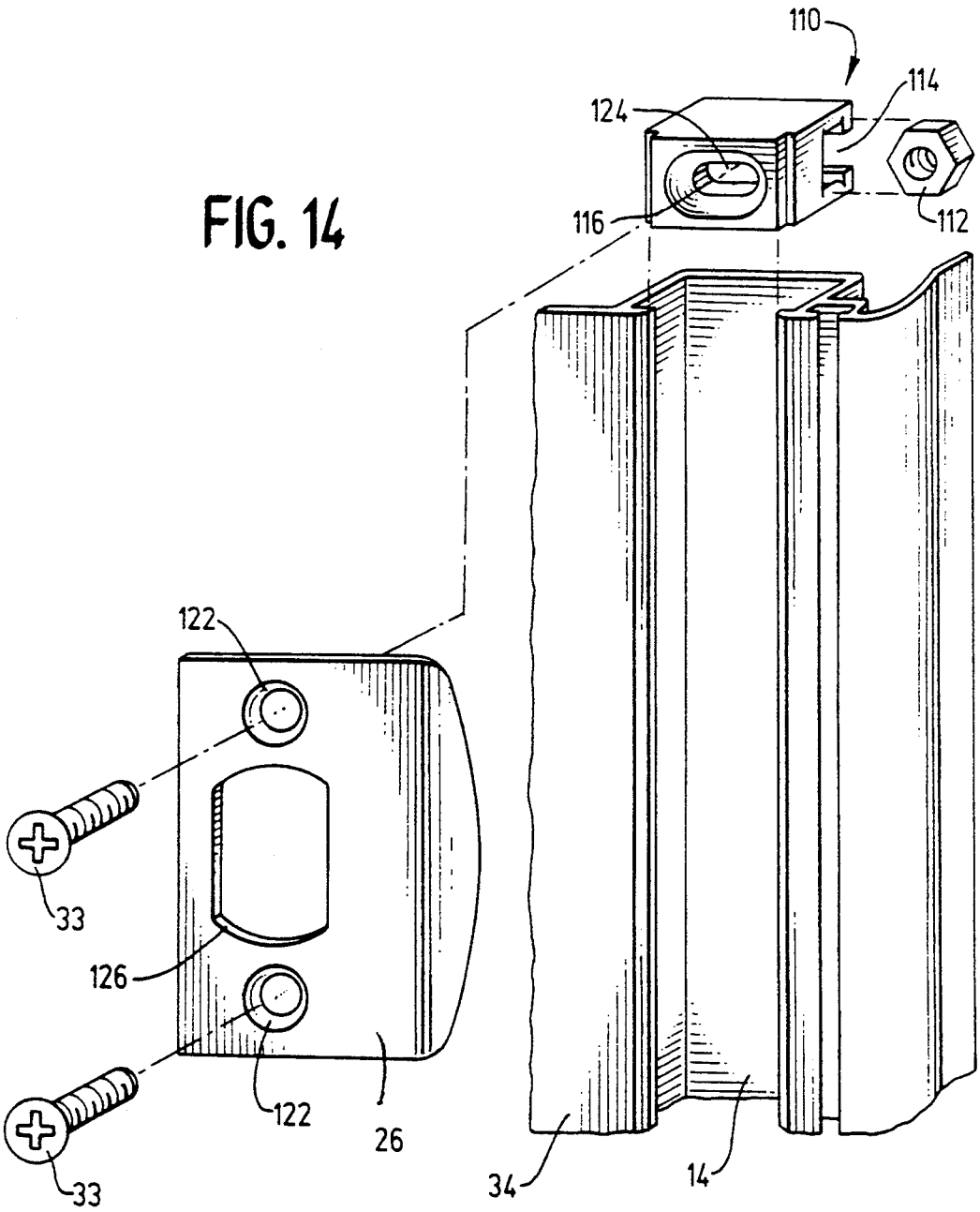
FIG. 14 is an exploded view of a strike plate and captive nut assembly of a separate embodiment of the present invention.
Figure 15B:
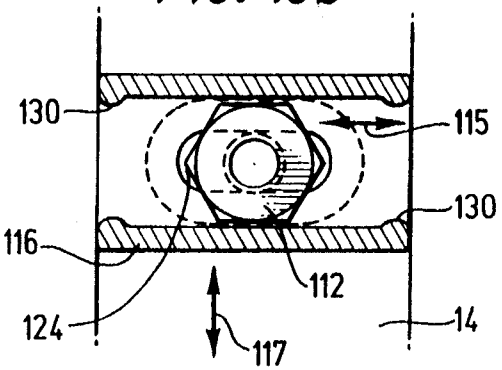
FIGS. 15*a* and 15*b* are top and longitudinal cross-sectional views of the block and nut included in the captive nut assembly.

FIG. 14 shows an exploded view of the strike plate and captive nut components. The captive nut 110 is assembled by sliding a hexagonal nut 112 through a slot opening 114 in a rectangular block 116. The width of the slot 114 is approximately equal to the hexagonal flats of the nut 112 yet sufficiently large to allow the nut 112 to slide within the walls of the block 116. As illustrated in FIG. 15*b*, ridges 130 are positioned at the edges of the slot 114 to prevent the nut 112 from slipping out of the slot 114 once it is inserted into the slot 114. To initially insert the nut 112 into the block 116, the nut 112 must be pushed past the ridges 130 which will resist the entrance of the nut 112. Once the nut 112 is slidably inserted into the block 116, its sliding motion will be limited between the ridges 130 which prevent the nut 112 from slipping out of the block 116.

Figure 15A:
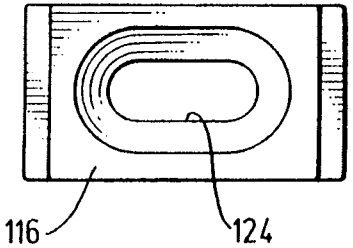

The width of the block 116 is approximately equal to the width of the channel 14, enabling the block 116 to fit slidably through the channel 14. FIG. 15*a* shows an oval-shaped aperture 124 in the top of the block 116. The aperture 124 is sized to provide room for the screw 33 to pass through to the nut 112 and to move laterally with the nut 112.

Figure 17:
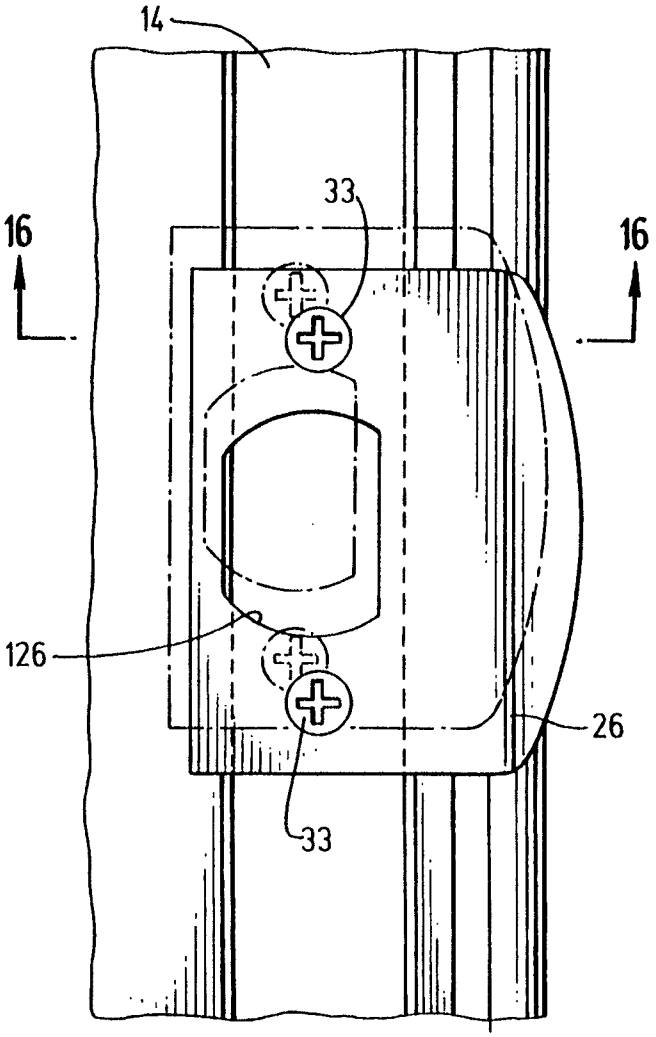
FIG. 17 is a phantom view of the shifted strike plate assembly of FIG. 14.
Figure 16:
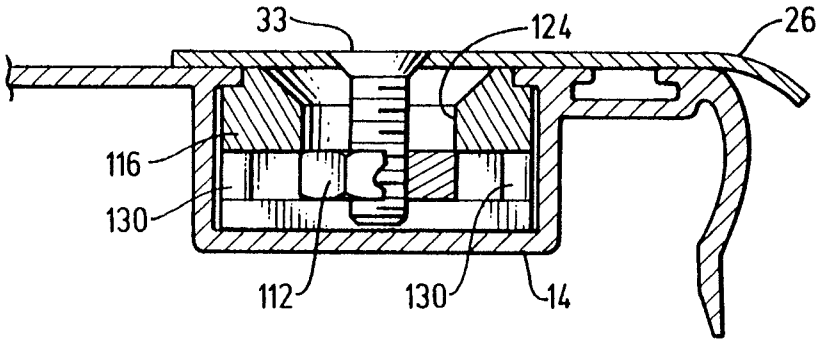
FIG. 16 is a cross-sectional view of a captive nut.

The captive nut 110 is capable of two-directional adjustment. The nut 112 is slidable within the slot 114 in the block 116, as indicated by arrows 115 in FIG. 15*b*. Simultaneously, the nut 112 and block 116 assembly together, i.e., the captive nut 110, are also slidable in the orthogonal direction along the length of the channel 14, indicated by arrows 117 in FIG. 15*b*. This two-way adjust ability ensures that each screw 33 can be met by a nut 112 (FIG. 16) with a wide range of positions after the strike plate is aligned (FIG. 17). As a consequence, the strike plate is readily aligned and then fastened to the astragal without the necessity for drilling or redrilling holes, It is seen from the above that the present invention provides an improved means of actuating spring-loaded bolts and retaining strike plates within a locking astragal attached to the inactive leaf of a double doorway. It will, of course, be understood that modifications of the present invention in its various aspects will be apparent to those skilled in the art, some being apparent only after study and others being matters of routine mechanical design.

Other embodiments are also possible, their specific designs depending upon the particular application. As such, the scope of the invention should not be limited by the particular embodiment herein described but should be defined only by the appended claims and equivalents thereof.

I claim:

1. An astragal, comprising:

an elongated casing having opposing ends and a casing aperture arranged between the opposing ends;

at least one locking bolt slidably positioned near at least one of the ends of the elongated casing, each locking bolt sliding between a first and second position;

at least one bolt latching member for selectively latching an associated locking bolt in the first and second positions, the latching member being pivotable between a latched position substantially within the caging aperture such that the locking bolt is latched and a released position substantially outside the casing aperture such that the locking bolt is unlatched, the latching member having an integral spring portion for biasing the latching member in the latched position.

2. The astragal according to claim 1, further comprising a plate defining apertures, wherein the latching member has a latching dog which is received in the apertures in the plate.

3. The astragal according to claim 2, wherein the latching dog has a face engaging the aperture and the face is at least 2 mm wide.

4. An astragal, comprising:

an elongated casing having opposing ends;

at least one locking bolt slidably positioned near at least one of the ends of the elongated casing, each locking bolt sliding between a first position and a second position;

at least one bolt latching member for selectively latching an associated locking bolt in the first and second positions, the latching member including integral trunnions and being pivotable about the integral trunnions between a latched position in which the locking bolt is latched and a released position in which the locking bolt is unlatched, the latching member further including an integral spring portion for biasing the latching member in the latched position.

5. An astragal assembly for sealing a spacing between an active leaf and an inactive leaf of a double doorway within a door frame, the astragal being fastened to the inactive door and adapted to be received by indentations in the door frame, the astragal comprising:

an elongated casing provided with upper and lower channels at opposing ends of the casing;

upper and lower locking bolts slidably positioned within the upper and lower channels, respectively, of the elongated casing, the bolts engaging the indentations in the door frame, each bolt sliding between a first extended position and a second retracted position;

upper and lower bolt actuating means slidably disposed within the upper and lower channels, respectively, for selectively latching the locking bolts in the first and second positions, the actuating means comprising a rectangular pull block provided with trunnion bearings, and an elongated latching member having trunnions pivotally mounted in the trunnion bearings of the pull block and having a manually actuable lever arm, a latching dog and an integral spring tail extending from the latching member for biasing the latching member in a latched position, the latching member being pivotable between the latched position in which the lever arm is released and an unlatched position in which the lever arm is depressed, wherein the latching member flexes at a crease when the lever arm is depressed;

upper and lower slide plates adapted to be slidably coupled to the bolt actuating means, each slide plate having at least a retracted position locking aperture and an extended position locking aperture, the apertures for receiving the latching dog of the latching member when the lever arm of the latching member is released and in the latched position, wherein when the latching member is depressed, the latching member flexes at the crease and disengages the latching dog from one of the apertures, enabling the bolt actuating means to slide over the associated slide plate to engage another aperture.

6. The astragal assembly according to claim 5, further comprising:

upper and lower bolt connectors coupled between each bolt actuating means and associated locking bolt, each connector having a spring pin at one end and being pivotally coupled at the other end by another spring pin to the locking bolt;

first and second set screws disposed perpendicularly on either side of each connector at the end of the connector coupled to the locking bolt; and upper and lower compression springs surrounding each connector, the compression springs being retained between the locking bolt and the set screws, wherein when the latching dogs are locked into the retracted position locking apertures in the slide plates, the locking bolts are retracted away from the indentations in the door frame and the compression springs surrounding the connector are compressed between the set screws and the ends of the bolts, and when the latching dogs are locked into the extended position locking apertures, the locking bolts are received by the indentations in the door frame and the compression springs are returned to their original shape.

7. The astragal assembly according to claim 5, wherein the pull block and trunnion bearings are made of a nylon material, and the latching member and trunnions are made of acetal plastic.

8. An astragal assembly, comprising:

an elongated casing having opposing ends and opposing sides; and at least one bolt-slide assembly coupled to at least one of the ends of the casing, the at least one bolt-slide assembly comprising a locking bolt, and a latching member coupled to the locking bolt, the latching member having an edge portion and a spring portion, the spring portion contacting one side of the casing to bias the edge portion against the other side of the casing to selectively latch the locking bolt;

wherein the latching member may be depressed by an operator when the astragal is in an assembled state to disengage the edge portion from the casing so that the latching member may be slid within the casing.

9. The astragal according to claim 8, wherein when the latching member is released, the edge portion of the latching member frictionally engages the a channel in the casing.

10. The astragal according to claim 8, wherein the spring portion is integral within the latching member.

11. The astragal according to claim 10, wherein the side of the casing in contact with the spring portion includes a plurality of detents for receiving the integral spring portion of the latching member.

12. An astragal assembly for sealing a spacing between an active leaf and an inactive leaf of a double doorway within a door frame, the astragal being fastened to the inactive leaf and adapted to be received by indentations in the door frame, the astragal comprising:

an elongated casing provided with upper and lower channels at opposing ends of the casing, the channels having a bottom surface; and at least one bolt-slide assembly coupled to the channels at the ends of the casing, the bolt-slide assembly comprising upper and lower locking bolts slidably positioned within the upper and lower channels, respectively, of the elongated casing, the bolts locking into the indentations in the door frame, and upper and lower latching members coupled to the upper and lower locking bolts, each latching member having an elongated body and a downwardly angled spring arm, the elongated body and spring arm together defining an integral spring portion for frictionally engaging the latching member to the associated channel to selectively latch the associated locking bolt, wherein when the elongated body is depressed, the spring arm flattens outwardly adjacent the bottom surface of the channel such that the latching member can slide through the associated channel in the casing, and when the elongated body is released the latching member is frictionally engaged in the channel.

13. The astragal assembly of claim 12, further comprising a plurality of detents formed in the bottom surface of the channel for receiving the free end of the spring arm of the latching member, wherein when the elongated body is released, the spring arm can engage one of the detents, and when the elongated body is depressed, the spring arm may be disengaged from the detent allowing the latching member to slide through the channel.

14. The astragal assembly of claim 12, wherein the latching member has at least one receptacle for receiving a bolt, and further wherein each bolt has at least one circumferential groove formed in its outer circumference, each circumferential groove of the bolt being adapted to snap securely into the corresponding receptacle in the latching member.

15. In an improved astragal assembly comprising an elongated casing provided with a channel positioned axially through the casing, upper and lower locking bolts slidable within the channel, and upper and lower actuating means coupled to the respective locking bolts, the improvement comprising:

upper and lower latching members mounted within the upper and lower actuating means, respectively, for selectively latching an associated locking bolt, each latching member being pivotable between a latched position in which the locking bolt is latched and a released position in which the locking bolt is unlatched when the astragal is in an assembled state, the latching member having an integral spring portion for biasing the latching member in the latched position.

16. The astragal assembly according to claim 15, further comprising upper and lower slide plates defining apertures, wherein the latching members have latching dogs which are received in the apertures.

17. The astragal assembly of claim 16, wherein when the latching members are depressed, the latching dogs are disengaged from the apertures, enabling the actuating means to slide adjacent the slide plates.

18. The astragal assembly according to claim 16, wherein the latching dogs are in the form of blocks and the locking apertures define generally rectangular shapes.

* * * * *